United States Patent [19]

Pennertz et al.

[11] 4,373,297

[45] Feb. 15, 1983

[54] DEBURRING MACHINE

[75] Inventors: Donald W. Pennertz; Ritchie J. Burkey, both of Alexandria, Minn.

[73] Assignee: Alexandria Extrusion Company, Alexandria, Minn.

[21] Appl. No.: 215,122

[22] Filed: Dec. 10, 1980

[51] Int. Cl.[3] ..... B24B 9/00; A47L 15/00

[52] U.S. Cl. ..... 51/84 R; 15/77

[58] Field of Search ..... 51/81 R, 81 BS, 83 R, 51/83 BS, 84 R, 84 BS, 92 R, 85 R, 82 R, 82 BS; 15/77

[56] References Cited

U.S. PATENT DOCUMENTS

| | | | |
|---|---|---|---|
| 1,440,386 | 1/1923 | Hawes | 51/83 R |
| 1,519,661 | 12/1924 | Brix | 51/85 R |
| 1,622,755 | 3/1927 | Asbridge | 51/84 R |
| 2,304,580 | 12/1942 | Luers | 51/84 R |
| 2,735,235 | 2/1956 | Luers | 51/84 R |
| 3,064,290 | 6/1960 | Bleke | 15/21 |
| 3,087,283 | 4/1963 | Heck | 51/84 R |
| 3,118,254 | 1/1964 | Lella | 51/92 R |
| 3,224,922 | 5/1963 | Kehr | 15/4 |
| 3,274,630 | 3/1965 | Mileikowsky et al. | 15/21 |
| 3,889,427 | 6/1975 | McCoy | 51/80 A |

*Primary Examiner*—Harold D. Whitehead

*Attorney, Agent, or Firm*—Kinney, Lange, Braddock, Westman and Fairbairn

[57] ABSTRACT

A deburring machine comprises a frame supporting a plurality of motor driven deburring brushes. At least two of the motors are spaced apart and a workpiece carriage is supported between them and movable generally in direction along the axis of rotation of the motors. A workpiece on the carriage engages the brushes driven by the motors to deburr the ends of a workpiece held on the workpiece carriage. The motors are adjustable to accommodate different lengths of workpieces, and also the workpiece holder itself is adjustable for different workpiece sizes.

4 Claims, 3 Drawing Figures

DEBURRING MACHINE

BACKGROUND OF THE INVENTION

1. Field of the Invention

The present invention relates to deburring machines for moving workpieces past abrading brushes for removing the burrs from the ends of the workpieces.

2. Prior Art

Brush type deburring machines for cut lengths of stock materials have been used in the past. For example, U.S. Pat. No. 3,274,630 shows a machine that does permit deburring of stock material or workpieces by transporting the workpieces on a chain type conveyor past a pair of brushes. The work holding conveyor continuously moves in a closed path and the workpieces have to be mounted on the chain for movement past the brushes. This causes for difficulties in loading, and limits the adaptability of the unit to various sizes of workpieces.

U.S. Pat. No. 3,889,427 shows a metal can or cup abrading machine where the work passes between opposing brushes. The brushes are made up of abrading cloth flaps, and as the brushes rotate, the can is also rotated to abrade the side walls of each of the cans or cups. Some adjustments can be made in the machine by sliding the slide shown at 4 in the drawings of the patent on the guideways 3 in order to compensate for brush wear, but not to permit readily changing the apparatus for different size workpieces. Additionally, the brushes are positioned at an angle with respect to the workpiece so that there is no movement of the workpiece along the axis of rotation of the brush, which makes adjustment easier.

U.S. Pat. No. 3,064,290 shows independently adjustable drive motors in a brushing machine. The machine itself, however, is a multi-stationed turret type machine for holding gears that are indexed and moved past the brushes.

U.S. Pat. No. 3,224,022 shows an abrading or deburring machine that illustrates the general state of the art for deburring apparatus.

SUMMARY OF THE INVENTION

The present invention relates to a unique arrangement of a workpiece support and carrier used in a deburring machine, operable in connection with motor driven brushes to move the workpiece past the brushes to remove burrs from the ends of the workpiece. The arrangement comprises at least two motors that are spaced apart, with the workpiece support positioned between the motors. Each of the motors drives an abrading brush having suitable abrasiveness and the motors are adjustable toward and away from the carrier to permit adjustment to accommodate workpieces of different lengths.

Once the motors are adjusted, the workpiece carrier is also adjusted to accommodate the piece to be deburred. The workpiece is placed on a plate, clamped in position through the use of pneumatic cylinders, and moved with a workpiece carrier past the abrading brushes for the deburring operation.

The machine includes pneumatic cylinders for controlling the movement of the workpiece carrier which permits easy, automatic operation of the machine.

The unit thus makes a highly efficient, relatively low cost but easily operable deburring machine.

BRIEF DESCRIPTION OF THE DRAWINGS

FIG. 1 is a top plan view of a deburring machine made according to the present invention;

DESCRIPTION OF THE PREFERRED EMBODIMENT

Figure 2:
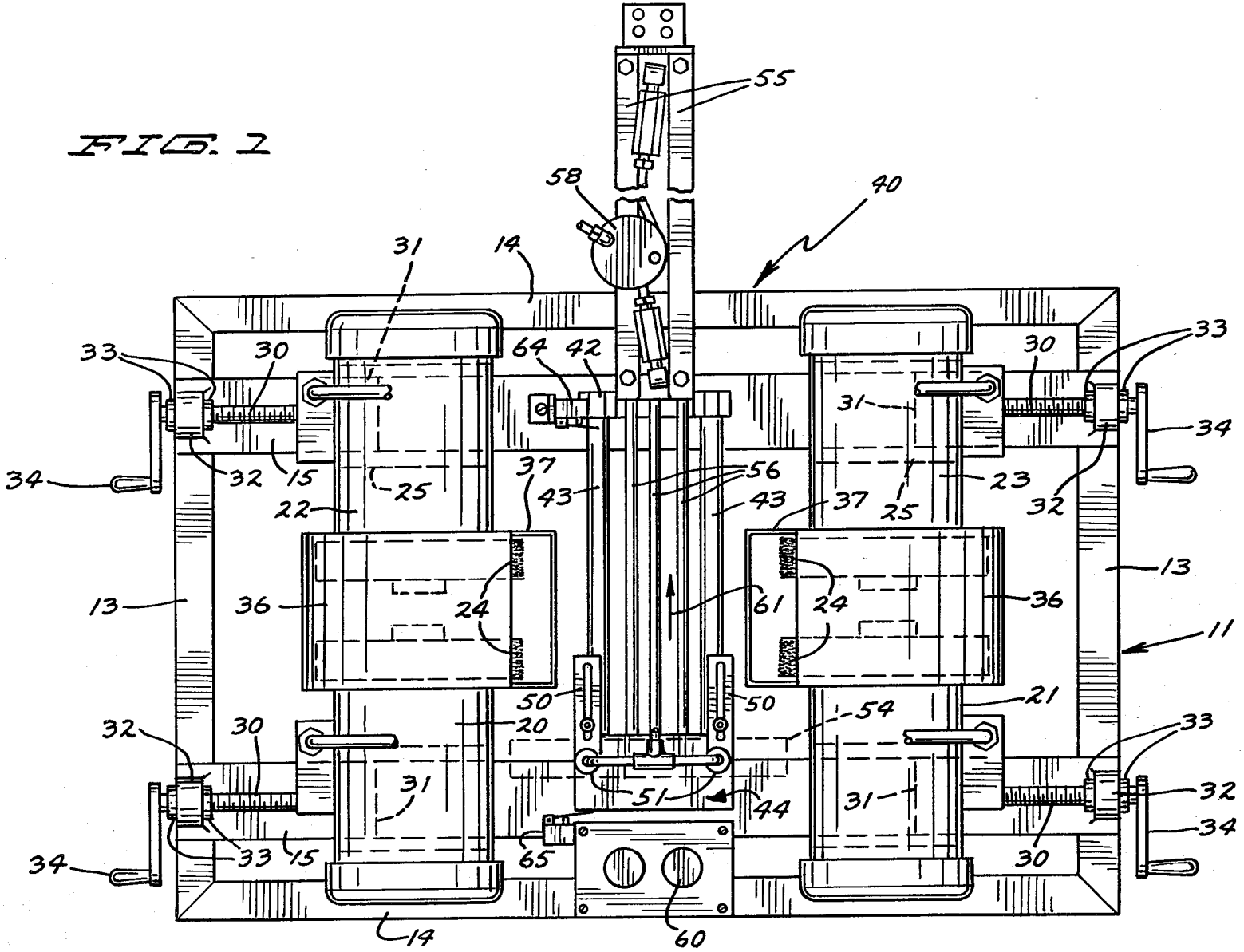
FIG. 2 is a fragmentary end elevational view of the deburring machine of FIG. 1.
Figure 2:
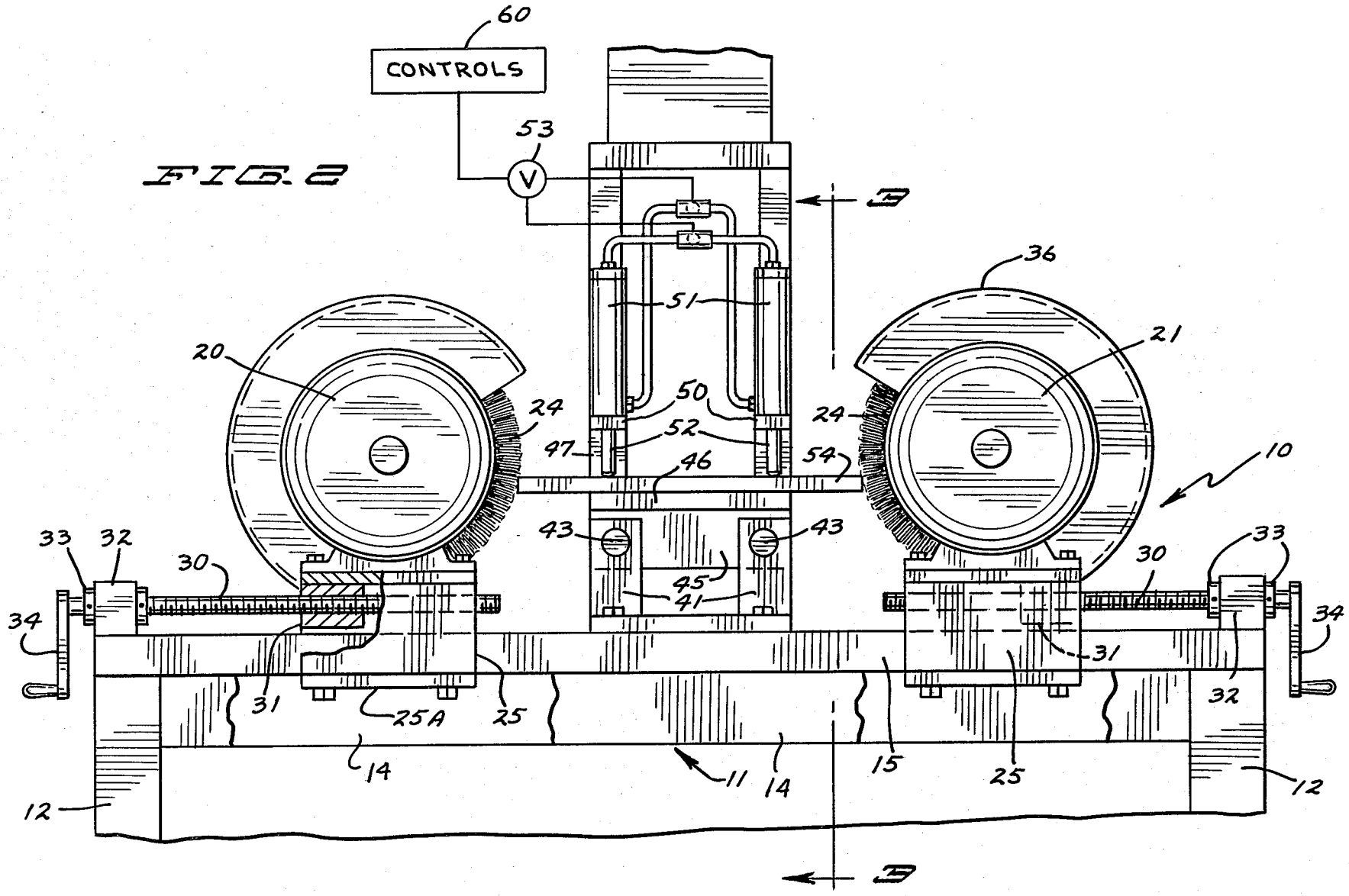
Figure 3:
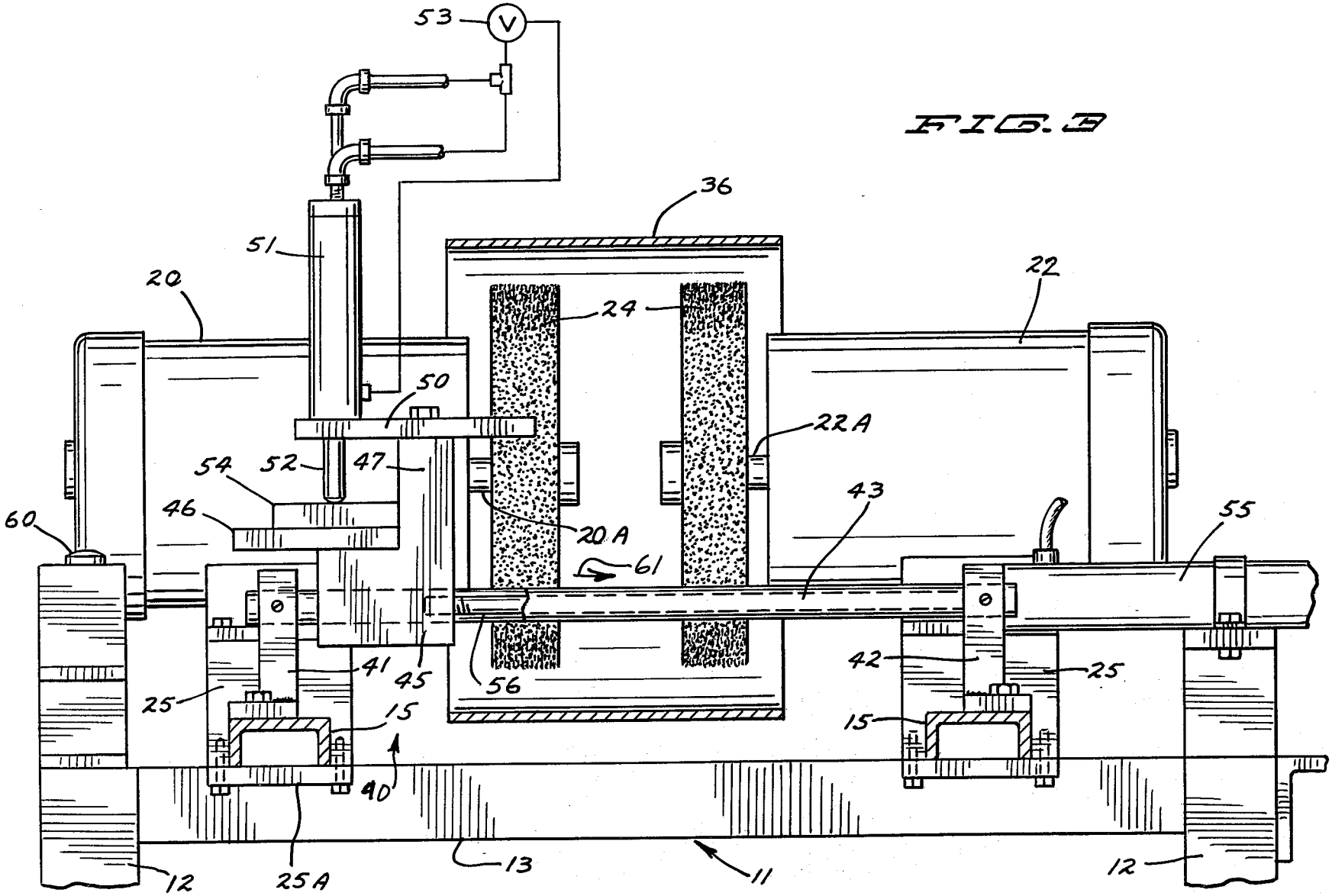
FIG. 3 is a sectional view taken on the line 3—3 in FIG. 2.

A deburring machine illustrated generally at 10 includes a support frame 11 which is supported on suitable legs 12, as shown in FIG. 2, and forms a perimeter frame. The perimeter frame includes end members 13, and longitudinal members 14. A pair of motor support rails or tracks 15 are mounted parallel to the side members 14 and are supported on the end members 13 to the frame 11. The tracks 15, as can be seen in FIG. 3, are generally channel-shaped tracks, that are fastened to the end frame members 13,13 in any desired way. The tracks 15 each support a pair of drive motors. For example, one track 15 supports a first motor 20 and a second motor 21 which are spaced apart on the track 15. The motors are positioned adjacent the respective end members 13 of the frame. The other track 15 supports motors 22 and 23. The motors 20 through 23 can be of any desired type, of suitable size to adequately drive abrading brushes 24, one of which is mounted on each of the output shafts 20A through 23A of the motors.

The motors 20–23 in turn are each mounted on sliding housing or track follower 25 that is made to fit over the respective track 15, and slide along the track. The position of each motor along the tracks 15 is controlled through the use of an individual screw assembly 30 that is threadably mounted into a suitable adjustment block 31 forming a part of each housing assembly 25. The screws 30 are rotatably mounted in supports 32 at the opposite ends of each of the tracks 15 and are held from axial movement with respect to the support by suitable collars 33. A crank 34 is provided at the end of each screw for threading the screw 30 through the block 31 and thus sliding the respective motor along the track 15 to the desired position in relation to the center line of the machine.

The sliding housing 25 has a plate 25A which may be used as a clamp, if desired. The plate would be loosened before turning screws 30 to adjust the motor position, and then the plates 25A would be tightened to clamp the motor securely in position.

It should be noted that each of the brushes 24 is independently mounted on a separate motor, and is driven by the respective motor shaft, for example, shafts 20A and 22A shown in FIG. 3. The brushes are slightly abrasive, comprising bristles coated with aluminum oxide.

The motors have a suitable guard or housing 36 over the brushes, and a vacuum dust removal housing 37 may be provided directly below the brushes and connected to a source of vacuum (not shown) to carry away dust from the deburring operation.

A work support and slide assembly 40 is positioned in the center portions of the frame. As shown, a pair of end support members 41 are mounted on one of the tracks 15 and a pair of support members 42 are mounted on the other track. The support members (one member 41 and one member 42) mount main guide rods 43 which span the space between the tracks 15 and slidably support a workpiece carrier 44. The workpiece carrier 44 as shown comprises a bracket 45 that is slidably mounted in suitable bearings or sliding bushings on the guide rods 43, and a generally horizontal workpiece support plate 46 is mounted on this bracket. Bracket 45 also has upright legs 47,47 that are spaced apart as shown in FIG. 2, and at the upper ends of the bracket legs 47, there are a pair of adjustable straps 50 each of which mounts a double acting pneumatic cylinder 51. The cylinders 51 are vertically oriented, that is, the axis of movement of the rods 52 of the cylinders 51 is vertical, and the internal pistons move in vertical direction. The rods 52 have end portions positioned above the plate 46, so that upon actuation of the cylinders 51 through the use of a valve shown schematically at 53, a workpiece shown only schematically at 54 can be clamped against the plate 46 and held in position for deburring.

The entire workpiece support 44, including the bracket 45, is movable in opposite directions along the two support rods 43 through the use of parallel connected pneumatic cylinders 55. The base ends of the cylinders 55 are mounted with suitable clips to the bracket 42 and to the table, if desired. The cylinders 55 can be any conventional pneumatic cylinders having rods 56. As shown, there are three rods 56, one for each of the cylinders 55 and the rods are parallel to the support rods 43. The cylinders 55 are double acting cylinders, that is, the rods 56 can be extended and retracted under fluid pressure. With motors 20 through 30 powered and rotating the brushes 24 once a workpiece 54 is positioned in the workpiece holder and a control 60 forming part of a control means is pushed, valve 53 operates the cylinders 51 and the rods 52 clamp the workpiece. The cylinders 55 can be automatically cycled by sensing when the workpiece has been clamped, either through a pressure switch or a limit switch forming part of the control means. The cylinders 55 are operated through a solenoid valve 58, for example, and will act to retract the rods 56 and pull the workpiece support 44 including the bracket 45 along the support rods 43 in the direction as indicated by the arrow 61 so that when the motors 20 through 23 are running, the brushes 24 will be rotating and will abrade the ends of the workpiece 54 as the workpiece is pulled past the brushes. The cylinders 55 are retracted so that the workpiece is pulled completely past both of the brushes at the opposite ends of the workpiece. The cylinders 55 are reversed, either manually or automatically through the operation of a suitable limit switch 64 that will operate valve 58 to change the direction of operation of the cylinders 55 and move the rods 56 back toward the start or home position so that the ends of the workpiece are abraded again as the workpiece moves back past both sets of brushes. A limit switch 65 may be used for detecting that the slide is back to its home position and used to reverse valve 53 and release the workpiece.

The air cylinders 51 are also double acting cylinders, and when the valve 53 is operated again, fluid under pressure raises the rods 52 and releases the workpiece 54 from its clamped position. The controls and sequencing can take many specific configurations.

The upright members 45 can be used as stops for the workpiece so that the workpiece can be slid into position along the support plate 46 against the stops and then clamped into position. The end to end positioning of the workpieces can be also made on a gage or stop after the workpiece length has been established, and the motors have been adjusted by turning the screws 30 to position the motors properly relative to the work support carriage or guide rods 43.

The deburring machine has the motors and brushes arranged so the opposite ends of the workpiece are deburred by four brushes. Two brushes engage the workpiece on the retraction stroke of cylinders 55 and the two brushes again engage the workpiece as the carrier is returned to its start position. The sequence is easily made semi-automatic so that once a start button is pushed, the workpiece is clamped, cylinders 55 retreat, the piece reaches a limit switch and reverses and when the workpiece carrier returns to its home or start position, the cylinders clamping the workpiece are released so the workpiece can be removed.

What is claimed is:

1. A deburring machine comprising:

a frame;

a pair of spaced parallel track members each having a longitudinal direction and being mounted on said frame;

a pair of motors on each track member mounted for selectable movement along the respective track member, each of said motors being spaced apart from the other motor on the respective track member, said motors each having an output shaft, and each motor output shaft having a separate abrading brush mounted thereon, the motors being oriented so that the output shaft of each motor on each track member is oriented facing toward a corresponding motor on the other track member and generally aligned therewith so that the brush of each motor on each track member is adjacent the brush of the corresponding motor on the other track member and located between the track members, the rotational planes of the brushes being between the track members;

a workpiece carrier;

means to slidably mount the carrier supported on and extending between and generally perpendicular to the track members, the means to slidably mount being positioned between the pair of motors on the respective track member;

a power cylinder mounted on the means to slidably mount and connected to the workpiece carrier to permit moving the workpiece carrier from a first home position on one side of the planes of all the brushes to a second retracted position on an opposite side of the planes of said brushes; and clamp means on said workpiece carrier to clamp and support an elongated workpiece with opposite end portions of the workpiece extending outwardly from the workpiece carrier, said motors being adjusted to position whereby the brush on each of the motors will engage portions of a workpiece carried on the workpiece carrier to deburr such workpiece as the workpiece carrier is moved between its home and retracted positions.

2. The apparatus of claim 1 wherein said means to slidably mount the workpiece carrier comprise a separate bracket fixed to each of the track members, and a pair of parallel guide rods mounted on said brackets and extending between said track members, said workpiece carrier being slidably mounted on said guide rods.

3. The apparatus of claim 1 wherein said workpiece carrier comprises a work holding station having a generally horizontal workpiece support bed, and wherein said means to clamp comprises bracket means overlying said workpiece support bed, at least one fluid pressure cylinder mounted on said bracket means and having an extendable rod overlying said workpiece support bed, and means to operate said cylinder to clamp a workpiece with said rod against said workpiece support bed.

4. The apparatus of claim 1 wherein said motors are slidably mounted on said track members, and screw thread means for selectively adjusting the position of each of said motors in direction along the longitudinal length of the respective track members.

* * * * *